United States Patent [19]

Mancini et al.

[11] Patent Number: 4,798,330

[45] Date of Patent: Jan. 17, 1989

[54] REDUCED COKING OF FUEL NOZZLES

[75] Inventors: Alfred A. Mancini, Farmington Hills; James W. Sager, Union Lake; Theodore R. Koblish, Birmingham, all of Mich.

[73] Assignee: Fuel Systems Textron Inc., Zeeland, Mich.

[21] Appl. No.: 829,269

[22] Filed: Feb. 14, 1986

[51] Int. Cl.[4] ..... F23D 11/00

[52] U.S. Cl. ..... 239/8; 239/105; 239/290; 239/300; 239/400; 239/406

[58] Field of Search ..... 239/400, 403–406, 239/112, 113, 290, 294, 300, 105, 8

[56] References Cited

U.S. PATENT DOCUMENTS

| | | | |
|---|---|---|---|
| 2,703,260 | 3/1955 | Olson et al. . | |
| 2,954,172 | 9/1960 | Grandman . | |
| 3,443,760 | 5/1969 | Simmons . | |
| 3,498,059 | 3/1970 | Gradon et al. . | |
| 3,520,480 | 7/1970 | Halvorsen . | |
| 3,576,384 | 4/1971 | Peczell et al. . | |
| 3,642,202 | 2/1972 | Angelo | 239/403 X |
| 3,684,186 | 8/1972 | Helmrich | 239/403 X |
| 3,785,570 | 1/1974 | Krieger . | |
| 4,105,163 | 8/1978 | Davis, Jr. et al. . | |
| 4,111,369 | 9/1978 | Sharpe . | |
| 4,139,157 | 2/1979 | Simmons . | |
| 4,362,022 | 12/1982 | Faucher et al. . | |
| 4,595,143 | 6/1986 | Simmons et al. | 239/406 |

FOREIGN PATENT DOCUMENTS 2022811 12/1979 United Kingdom .

OTHER PUBLICATIONS

Beer et al., "Combustion Aerodynamics", Robert E. Krieger Publishing Co., 1972, pp. 100–147 and 196–211.

Gupta et al., "Swirl Flows", Abacus Press, 1984, pp. 119–163.

Shakespeare et al., "Pressure Drop in a Confined Vortex With High Flow Rate", date unknown, pp. 25–33.

*Primary Examiner*—Andres Kashnikow

*Attorney, Agent, or Firm*—Edward J. Timmer

[57] ABSTRACT

Coking of the hot external face of fuel nozzles operating in the combustor of a gas turbine engine is reduced by controlling air discharging from the nozzle face in a manner to provide a recirculation zone spaced away from the nozzle face a distance effective to substantially reduce coking and yet maintain a stable flame front in the combustor.

18 Claims, 3 Drawing Sheets

FIG. 1
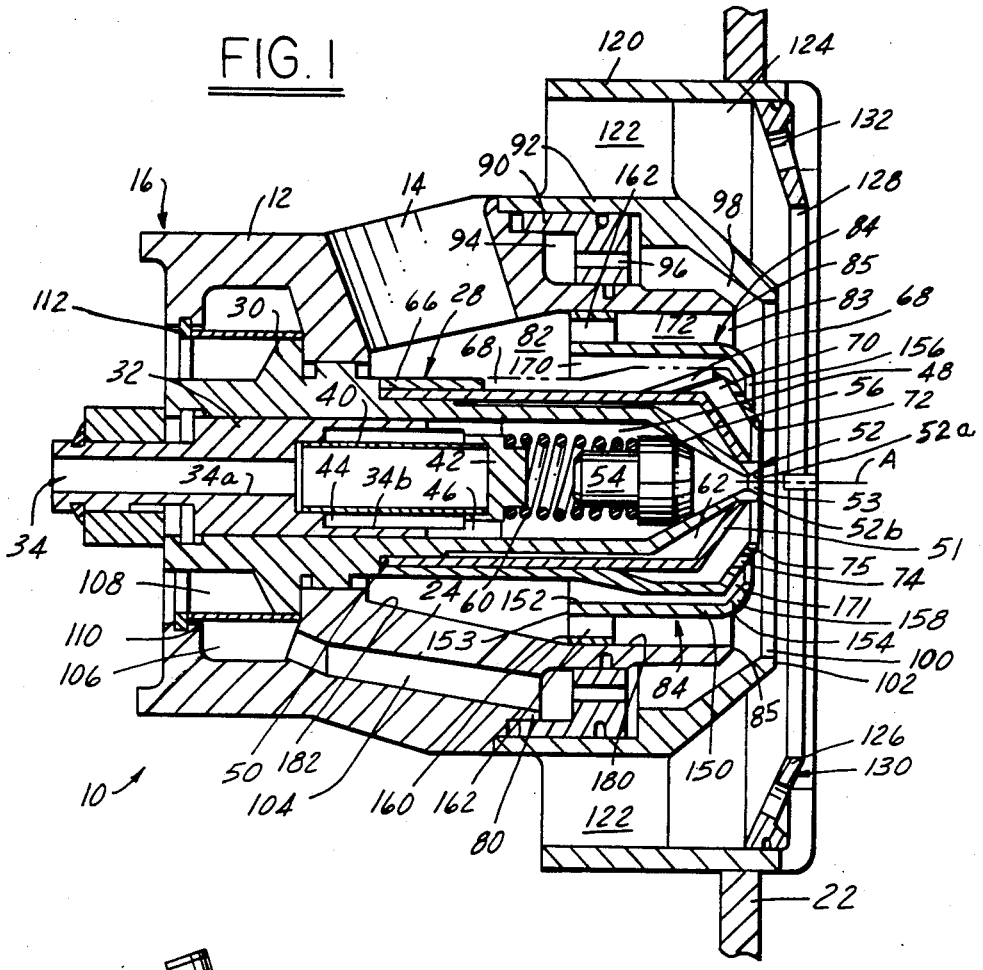
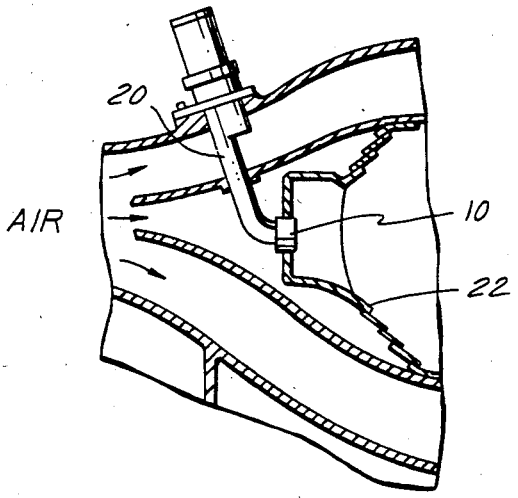
FIG. 2

REDUCED COKING OF FUEL NOZZLES

This invention relates to fuel nozzles for gas turbine type power plants and in particular to fuel nozzles which exhibit reduced coke or carbon buildup on nozzle face surfaces in operation as well as methods for reducing such coking.

BACKGROUND OF THE INVENTION

In use, fuel nozzles of the piloted or dual orifice type used in gas turbine engines have exhibited a two-fold fouling problem comprising internal coking and external coking which may adversely affect operation and performance of the nozzle. Internal coking is evidenced by carbonaceous type deposits on internal fuel passages resulting from chemical breakdown of fuel from excess heat and residence time in the nozzle. U.S. Pat. No. 4,362,022 issued Dec. 7, 1982 and U.S. Pat. No. 4,111,369 issued Sept. 5, 1978, disclose dual orifice nozzle constructions attempting to overcome internal coking in the internal secondary fuel passage of the nozzle.

External coking or carboning appears on the hot external surfaces of the nozzle face also in the form of carbonaceous type deposits resulting from distillation and/or liquid phase reactions of fuel on the face surfaces. External coking as a result of distillation involves buildup of residues with boiling points above local surface temperatures whereas liquid phase reactions involve other phenomena.

U.S. Pat. No. 3,498,059 issued Mar. 3, 1970 discloses a fuel nozzle for a gas turbine engine constructed to prevent carboning in operation in the engine combustor.

U.S. Pat. No. 4,139,157 listed above describes clogging of primary fuel flow passages as a result of carbonizing of residual fuel therein when primary fuel flow is discontinued.

Piloted or dual orifice fuel nozzles, i.e., nozzles having a pressure atomized low flow fuel discharge past a primary nozzle orifice for engine start-up and low power operation and having a pressure atomized and/or air-atomized high fuel flow discharge through a secondary nozzle orifice for high power engine operation, are shown in U.S. Pat. No. 2,703,260 issued Mar. 1, 1955; U.S. Pat. No. 2,954,172 issued Sept. 27, 1960; U.S. Pat. No. 3,443,760 issued May 13, 69; U.S. Pat. No. 3,520,480 issued July 14, 1970; U.S. Pat. No. 3,684,186 issued Aug. 15, 1972; U.S. Pat. No. 3,785,570 issued Jan. 15, 1974; U.S. Pat. No. 4,105,163 issued Aug. 8, 1978 and U.S. Pat. No. 4,139,157 issued Feb. 13, 1979. British published application 2,022,811 discloses a dual orifice hybrid fuel nozzle for a gas turbine. When a pressure atomized low or primary fuel discharge is employed with an air-atomized (either air-assisted or air-blast) high or secondary fuel discharge from respective orifices, the fuel nozzle is commonly referred to as a hybrid type.

U.S. Pat. No. 3,684,186 listed above illustrates a central pilot or primary fuel conduit having a heat shield on the discharge end and a downstream air diverter with a closed downstream end on the heat shield. However, the nozzle is said to be designed to effect burning close to the nozzle face and to this end the exposed faces of the primary orifice and heat shield are normal to the longitudinal axis of the nozzle.

The aerodynamics of a spiral-swirling turbulent fluid jet emerging from the orifice of a swirl nozzle are described in technical publication *Combustion Aerodynamics*, p. 102, 1983. There it is indicated that for strong spiral swirl, an adverse axial pressure gradient is sufficiently large to result in reverse flow along the axis of the spiraling flow field and the setting up of an internal central recirculation zone or core of torroidal shape and relatively low pressure in the spiraling jet emanating from the burner nozzle. The recirculation zone constitutes a hot zone of combustion products and unburned fuel. A swirling flow field with a swirl number S' greater than 0.6 is said to be necessary to develop the recirculation zone while a swirl number less than 0.6 is said not to provide axial pressure gradients sufficiently large to cause internal recirculation unless there is a blockage such as a stabilizer bluff body, fuel pipe or pressure jet oil gun in the nozzle, which is instrumental in establishing a recirculation zone. The presence of the recirculation zone plays an important role in flame stabilization in the burner and flame parameters, such as stability, combustion intensity and residence time distribution in combustors, depend on the strength of the vortex of the recirculation zone.

SUMMARY OF THE INVENTION

The invention contemplates fuel nozzle constructions of the type having a recirculation zone of combustion products and unburned fuel associated therewith useful for the combustor of a gas turbine engine by virtue of their reduced tendency to exhibit coking of nozzle face surfaces at the discharge end thereof exposed in the combustor. The invention relates to the discovery that the presence of the recirculation zone, especially its location relative to external nozzle face surfaces, plays an important and dramatic role in the deleterious coking of the nozzle face during operation in a gas turbine engine.

The invention contemplates such nozzles having means thereon for controlling air flow from the nozzle face in a manner to establish a recirculation zone spaced away from the nozzle face an effective distance to substantially reduce coking thereof while maintaining adequate flame front stability in the combustor.

In a working embodiment of the invention, the fuel nozzle construction includes an inner primary fuel assembly including a primary fuel conduit with a primary fuel discharge end and an outer annular secondary fuel conduit disposed around the primary fuel conduit and having a secondary fuel discharge end, an annular air passage located in the space between the primary conduit and secondary conduit and means in the air passage for controlling air flow from the air discharge end in such a manner as to provide the recirculation zone spaced away from the nozzle face and not impinging thereon to reduce coking on the external discharge surfaces of the fuel nozzle. A plurality of air inlet openings generally tangentially oriented relative to the longitudinal axis of the nozzle are provided for supplying air to the air passage.

In one embodiment of the invention, the means for controlling recirculation zone location includes a tubular air splitter means disposed in an elongate air passage around and spaced from the primary fuel assembly and having a downstream discharge end adjacent the primary fuel conduit discharge end and further having an annular open upstream air entry end spaced radially from the primary fuel assembly to define an annular air receiving chamber therein. The upstream end is disposed generally coincident or intersecting with a projection of the air inlet openings into the air passage for capturing incoming air at near minimum vortex strength in the elongate air passage; i.e., capturing incoming air at a location in the air passage where the vortex core diameter or lateral dimension is near minimum.

In another embodiment of the invention, the means for controlling recirculation zone location includes a tubular air splitter-swirler means disposed in the air passage around and spaced from the primary fuel conduit. The air splitter-swirler means includes an open downstream discharge end adjacent the primary fuel conduit discharge end for discharging air flow thereover and an open annular air entry upstream end spaced radially from the primary fuel assembly to define an air receiving chamber therein for capturing incoming air from air inlet openings. A radially extending collar or shoulder extends from the upstream end toward the secondary fuel conduit. The collar includes a plurality of air swirl passages circumferentially spaced therearound, preferably greater in number than the number of air inlet openings, for imparting swirl to an outer air flow in the air passage flowing around the air splitter-swirler means for discharge at the downstream end to atomize fuel. The collar creates a blockage and back pressure upstream of the air splitter-swirler means and resultant higher static pressure for feeding more air to the open upstream air entry end.

The method of the invention provides for reducing coking on external nozzle face surfaces by controlling air flow from the nozzle face in such a manner that the recirculation zone is spaced away from the external nozzle face a sufficient distance to substantially reduce coking thereon while maintaining satisfactory flame stability in the combustor. The location of the recirculation zone relative to the nozzle face is controlled by changing swirl strength (quantified by swirl number S') of discharging air locally near coke-prone nozzle surfaces using tangential and/or axial air velocity control near coke-prone nozzle surfaces.

BRIEF DESCRIPTION OF THE DRAWINGS

FIG. 1 is a longitudinal cross-sectional view of a fuel nozzle of the invention.

FIG. 2 is a partial longitudinal cross-sectional view of a gas turbine engine combustor with a fuel nozzle therein.

DESCRIPTION OF PREFERRED EMBODIMENT

Figure 5:
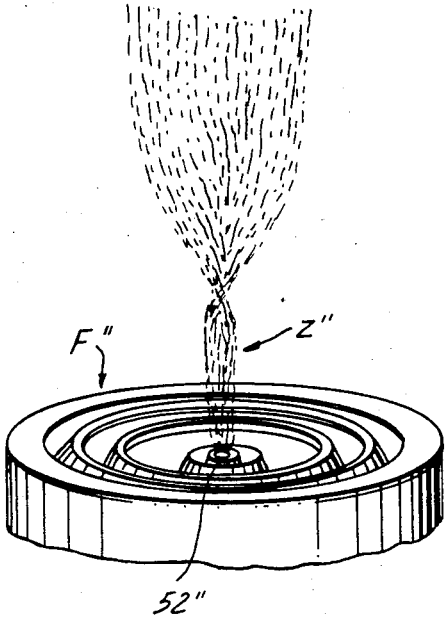
FIG. 5 is similar to FIG. 4 showing a recirculation zone of another fuel nozzle.

FIG. 1 illustrates a preferred fuel nozzle construction of the aforementioned hybrid type for reducing coking of external nozzle tip or face surfaces exposed in the combustor of a gas turbine engine.

The fuel nozzle 10 includes a main nozzle body 12 having a plurality of air inlet apertures 14 arranged in spaced relation around its circumference; e.g., six apertures (slots) spaced apart by 60°. The apertures 14 extend tangentially into the body 12 relative to its longitudinal axis A. Apertures 14 receive discharge air from the compressor of the gas turbine engine in known fashion and supply that air to internal nozzle air supply system to be described below.

The nozzle body includes an upstream end 16 which may have threads (not shown) for threadable engagement in a threaded opening (not shown) of a support strut 20 by which the nozzle is suspended in the combustor 22 of a gas turbine engine, FIG. 2.

The nozzle body 12 is hollow and includes a central longitudinal elongate bore 24 in which a primary fuel assembly 28 is received and affixed; e.g., by threadable or other engagement therein. The primary fuel assembly 28 includes an outer primary body 30 which may be clamped or threadably affixed in bore 24 and an inner primary body 32 having longitudinal passage 34 therein having a small diameter portion **34*a* and large diameter portion 34*b*. Located in large chamber portion 34*b* is a tubular metal mesh fuel filter 40 with an open upstream end and a downstream end closed off by cap 42. The downstream portion of the inner primary body 32 adjacent the fuel filter is configured to provide an annular manifold chamber 44 and multiple circumferentially spaced slots 46. Slots 46 communicate in fuel flow relation with chamber 48 defined within the downstream end of the outer primary body 30. As is apparent, the downstream end of outer primary body 30 tapers to a conical discharge end or orifice 53 having an annular discharge lip or face 52 including an outwardly diverging portion 52*a* and planar annular portion 52*b* as shown. In chamber 48 is positioned a plug 54 having a primary fuel metering slot 56. The plug 54 and cap 42 are held in stationary position in chamber 48 by coil spring 60**.

Primary fuel flows from the support strut into longitudinal primary fuel passage 34 through fuel filter 40 and into manifold chamber 44 from which it flows into chamber 48. The primary fuel is metered through slot 56 in the plug 54 and is discharged out discharge orifice 53 past lip 52 and pressure atomized in the form of a conical spray into the combustor.

Affixed as by welding on the exterior of the outer primary body 30 is a tubular heat shield member or sleeve 50. Heat shield sleeve 50 has a conical face 51 exposed to the combustor. As shown, a dead air space 62 is thereby provided around the outer primary body as an insulating means to retard development of elevated temperatures therein that could volatize the primary fuel therein and lead to internal coking.

Also affixed on the outer primary body 30 is a sweep air tubular sleeve 66 having multiple circumferentially spaced air entrance slots 68 therein to receive air as described hereinbelow. Air entering slots 68 flows through conical chamber 70 and is discharged in part past annular air discharge orifice 72 and in part through multiple circumferentially spaced air discharge apertures 74 in the exposed downstream face 75 of sleeve 66.

Annular air discharge lip 72 and annular primary fuel discharge lip 52 are concentric relative to longitudinal axis A.

As shown in FIG. 1, downstream end 80 of main nozzle body 12 surrounds the primary fuel assembly just described and forms therebetween an inner annular elongate air supply passage 82 which receives compressor discharge air from tangentially oriented air inlet apertures 14. Positioned in the annular air supply passage 82 is an air splitter-swirler member 84 which will be described in more detail hereinafter. Inner air in supply passage 82 discharges in part past an inner air discharge orifice 83 and lip or face 85 and in part through sweep air sleeve 66 past its discharge orifice 72 as explained above.

On the exterior of the downstream end 80 of the main nozzle body is a tubular secondary ring 90 and tubular secondary body 92. Both can be welded or otherwise affixed on the main nozzle body. Secondary ring 90 forms with the opposite shoulder on the main nozzle body an annular secondary fuel manifold chamber 94 and includes multiple circumferentially spaced apart fuel passages 96 extending axially from chamber 94 to fuel swirl chamber 98 formed within outer secondary body 92. Outer secondary body 92 terminates in a secondary fuel discharge orifice 100 and annular discharge lip or face 102.

A generally axially extending passage 104 extends upstream from secondary fuel manifold chamber 94 to an upstream annular manifold chamber 106 which receives secondary fuel from annular chamber 108 via a tubular fuel filter member 110. Of course, annular chamber 108 receives fuel from a secondary fuel passage (not shown) in the support strut as is known. Filter member 110 is held in place by snap ring 112.

Secondary fuel, when required for high power operation of the gas turbine engine, thus flows into passage 104 to manifold chamber 94 through apertures 96 into fuel swirl chamber 98. From that chamber, fuel is discharged into the combustor through orifice 100 past lip 102 in the form of a fuel spray cone.

The secondary body 92 includes on the exterior thereof a tubular cylindrical outer sleeve 120 and a plurality of circumferentially spaced apart air swirl vanes 122 therebetween. Compressor air passes swirl vanes 122 and flows through outer air swirl chamber 124 defined in part by sleeve 120 and annular stub sleeve 126 welded to sleeve 120. Stub sleeve 126 terminates in outer air discharge orifice 128 and annular discharge or face lip 130. Part of the air in swirl chamber 124 discharges out multiple circumferentially spaced apart apertures 132 in stub sleeve 126.

The swirl strength or swirl number of air discharging through orifice 128 is typically greater, e.g., by a factor of 2 or more, than the swirl strength of inner air discharging through orifice 83.

In operation, the air flow through inner annular passage 82 discharging in part past inner air discharge orifice 83 and lip 85 and outer air discharging past orifice 128 and lip 130 help atomize secondary fuel discharging from fuel discharge orifice 100 and lip 102. Inner air flow through sweep air sleeve 66 discharging through discharge orifice 72 provides sweep air past lip 52. Inner air discharging through apertures 74 functions to vent the wake region on the downstream face 75. Apertures 132 of stub sleeve 126 function in like manner to discharge air.

The problem encountered in heretofore utilized fuel nozzles of the general hybrid type described has been coking, or buildup of carbonaceous deposits, especially on primary fuel discharge lip 52 exposed face 51 of the heat shield sleeve 50 and to a lesser extent the exposed face 75 of sweep air sleeve 66. Buildup and partial bridging of coke or carbonaceous deposits between lip 52 and face 75 has been experienced in severe coking cases. Coking of the nozzle lips or faces adversely affects operation of the fuel nozzle.

The present invention relates to the discovery that the presence of the recirculation zone, especially its location relative to the aforementioned nozzle lips or faces forming the external nozzle face, plays an important and dramatic role in deleterious coking of the nozzle surfaces described. In particular, it has been discovered that severe coking of the external nozzle face surfaces as described results in large part from impingement or attachment of the recirculation zone on the nozzle face surfaces and that the establishment or location of the recirculation zone spaced downstream from these nozzle surfaces out of inpingement therewith can significantly reduce coke buildup while maintaining adequate flame front stability in the combustor. Spacing the recirculation zone from the nozzle face as far as possible for coke reduction while retaining satisfactory combustion or flame stability serves to decrease the radiant and convective heat load or input onto the coke-prone nozzle face surfaces and to decrease contact or migration of fuel onto the hot coke-prone nozzle faces or surfaces, although Applicants do not wish to be bound by this theory.

Part and parcel with positioning of the recirculation zone downstream away from and not impinging on the nozzle face surfaces, better air washing of the coke-prone nozzle face surfaces is provided and results in reduced coking. In particular, higher air flow rates are provided past the primary fuel discharge lip or face 52 and to wash exposed faces of the heat shield sleeve 50 and sweep air sleeve 66 and locally change swirl strength of discharging air therearound as a result of the discovery that the flow of air through air splitter-swirler member 84 and sweep air sleeve 66 is a function of the vortex or swirl strength of air flow passing through passage 82 from inlet apertures 14 to discharge lip 52 as described hereinbelow.

Referring to FIG. 1, positioning of the recirculation zone away from the exposed nozzle face surfaces and greater air flow rates for washing the coke-prone surfaces and locally reducing air swirl strength by increasing the axial velocity component of the air flow are provided by air flow controlling means on the nozzle which includes the combination of air splitter-swirler member 84 with the various air supply and discharge passages, orifices and lips referred to above. As shown, the air splitter-swirler member 84 includes an axially extending cylindrical tubular portion 150 around and spaced from the primary fuel assembly 28. The tubular portion includes a cylindrical tubular portion 152 extending upstream toward tangentially oriented air inlet apertures 14 terminating in an open annular air entry end 153 in proximity to apertures 14 and spaced radially from the primary fuel assembly 28 and a converging conical type portion 154 at the downstream end terminating in an open annular air discharge orifice 156 and annular air discharge lip or face 158 just short of the downstream end of the sweep air sleeve 66 as shown.

Adjacent the upstream end of the cylindrical tubular position 152 is an annular cylindrical collar 160 extending toward and against the inner cylindrical wall 180 of the main nozzle body and having a plurality of circumferentially spaced air swirling passages 162 oriented at an angle relative to longitudinal axis A to impart swirl to air passing therethrough. Preferably, the number of air swirling passages 162 exceeds the number of tangentially oriented air inlet apertures 14. Collar 160 functions as a means on the air splitter member for reducing air velocity and creating back pressure with higher static pressure in the portion of air passage 82 upstream of air entry end 153 so that more air is available for capturing by chamber 170.

As mentioned, the upstream end of the air splitter-swirling member 84 is positioned for a given nozzle design in proximity to the entrances of air inlet apertures 14 and collar 160 creates a higher static upstream air pressure such that sufficient air flow is captured by annular air chamber 170 defined within the air splitter-swirler member 84 exteriorly around primary fuel assembly 28 for establishing the recirculation zone downstream spaced away from the nozzle face and for providing greater air flow rate for washing coke-prone nozzle face surfaces. At the same time, sufficient air flow is captured in annular air chamber 172 between the air splitter-swirler member and main nozzle body for discharge through orifice 83 primarily for venting the flow region immediately downstream thereof and secondarily for atomizing secondary fuel discharging through orifice 100.

Since the air splitter-swirler member 84 creates a blockage and resultant back pressure upstream thereof tending to reduce swirling of upstream air entering from the air inlet apertures 14, swirling passages 162 are provided to establish a desired level of swirling for the air flow discharging through orifice 83.

In FIG. 1, the open upstream air entry end 153 of the air splitter-swirler member 84 is positioned at or adjacent the juncture between the cylindrical inner wall 180 and tapered wall 182 of the main nozzle body in proximity to apertures 14 to permit a cylindrical outer periphery on the collar 160 to be employed. A preferred position for the upstream end of the air splitter member without an air blockage collar is generally coincident with a projection of the air inlet apertures 14 into the inner air passage 82 e.g., as shown in FIG. 8 for another embodiment of the invention, the projection being represented by the dashed line P.

In accordance with the present invention, the position of the upstream end of the air splitter-swirler member 84 is located in a manner to enable chamber 170 to capture sufficient air within air splitter-swirler member 84 for the above-stated purposes at a location in passage 82 where the incoming air vortex in passage 82 has a near minimum vortex core diameter; i.e., where the actual air flow radial film thickness is relatively large compared to air film thickness downstream thereof. Since air entering swirling apertures 14 and swirling in passage 82 in the form of a vortex causes the air flow to segregate radially outward from centrifugal or vortex effects and since such segregation of inner air radially outward toward inner wall 180 of the main nozzle body tends to increase along the length of air passage 82 toward the discharge orifice 83, increasing the lateral size of the vortex core and reducing the actual air flow radial thickness along the length of passage 82, the position of the upstream end 153 of the air splitter-swirler 84 should be positioned near the entrances of the air inlet apertures 4 into passage 82 where the incoming air will have a substantially minimum vortex core internal size or diameter compared to a larger vortex core diameter in the direction toward discharge orifice 83 and greater air film thickness; i.e., at the initial vortex formation area in passage 82. Placement of the open upstream end of sweep air member 66 of a fuel nozzle without the air splitter member substantially downstream of air inlet apertures 14 in large vortex core areas as taught by the prior art positions that end in a low to negative air pressure region results in insufficient air capturing for the above-stated purposes.

Figure 8:
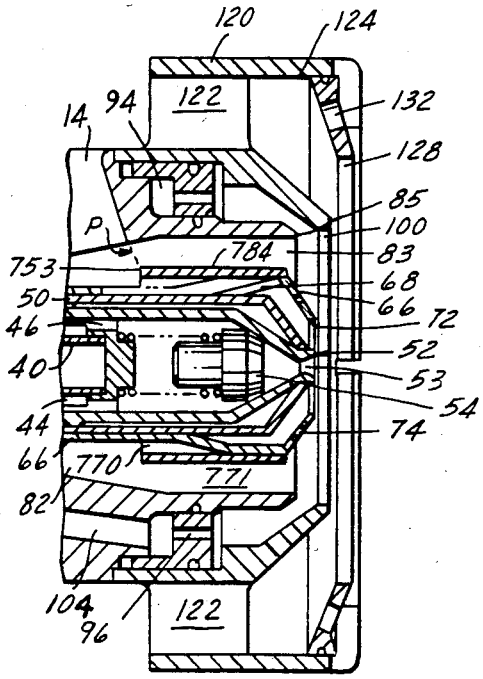
PRIOR ART FIG. 8
FIG. 8 is a partial longitudinal cross-sectional view of another embodiment of the invention.

Presence of collar 160 on air splitter-swirler member 84 permits flexibility in the placement of the upstream end 153 thereof as a result of the back pressure generated upstream; i.e., the upstream end 153 need not be as close to the entrance of apertures 14 as for example the upstream end 753 in FIG. 8 where there is no collar. The collar 160 functioning as air blockage and back pressure generating means provides much enhanced air entry into chamber 170 for the above-stated purposes.

Inner air flowing within chamber 170 of the air splitter-swirler member 84 is itself split further int different streams with an inner part or stream flowing through chamber 70 of the sweep air sleeve 66 and outer part or stream through chamber 171 past discharge orifice 156 and discharge lip 158. The convergence of chamber 171 is selected to direct sweep air past the exposed face of the sweep air sleeve 66. As mentioned, air flowing through the sweep air sleeve 66 is discharged over the primary fuel lip 52. The air flows provided by the fuel nozzle shown in FIG. 1 are effective to position or establish the recirculation zone away from the coke-prone nozzle surfaces described as well as provide greater sweep air flow for washing these coke-prone surfaces thereby reducing swirl strength of discharging air locally around coke-prone nozzle surfaces.

Figure 3:
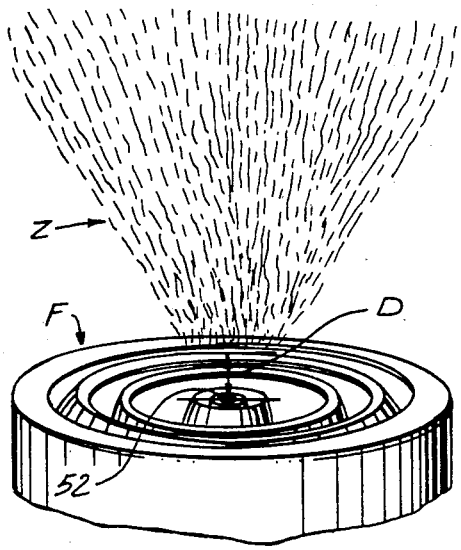
FIG. 3 is a perspective representation of the recirculation zone of the fuel nozzle of FIG. 1 as formed by air bubbles in a water chamber.

FIG. 3 illustrates the position of the recirculation zone Z for the fuel nozzle of FIG. 1 as established in a bubble chamber wherein water is located over the horizontal nozzle face F and wherein water flow with entrained air bubbles is supplied through outer air passage 124 through orifice 128 and water flow without entrained air bubbles is supplied through inner air passage 82 to generate the recirculation zone Z. In FIG. 3 and FIGS. 4–6 to follow, the Reynolds number of the water flow is selected to simulate the velocity of inner and outer air flow of the nozzle. No water flow is provided through the primary or secondary fuel passages. The bubbles are subjected to the flow patterns involved and provide visual illustration of the recirculation zone. It can be seen that the recirculation zone Z for the fuel nozzle of FIG. 1 is spaced a distance D from the lip 52 of nozzle face F.

Figure 4:
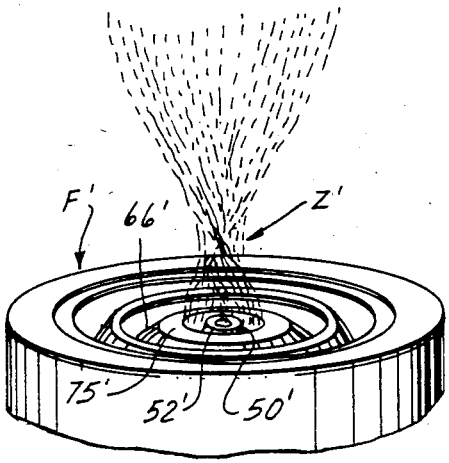
FIG. 4 is a similar view of a recirculation zone of a fuel nozzle generally similar to that of FIG. 1 without the air splitter-swirler member and with different orifice dimensions, inner and outer air flow rates and different swirl numbers for the air flows.

In contrast, FIG. 4 illustrates the recirculation zone Z' formed in a similar way in the bubble chamber relative to the face F' for a generally similar fuel nozzle (wherein generally like features are represented by like numerals primed) without the air splitter-swirler member 84, with the air entry end of a sweep air member positioned substantially downstream in the inner air passage in a low or negative pressure region and with different orifice dimensions, inner and outer air flow cross-sectional areas and thus different swirl numbers for the water flows simulating inner and outer air flows. It is apparent that the recirculation zone impinges on the nozzle face F', including primary fuel nozzle lip or face 52' and heat shield member 50' and extends laterally or diametrically to the exposed 75' face of sweep air sleeve 66'.

FIG. 5 illustrates the recirculation zone Z'' formed in a similar way in the bubble chamber for another generally similar fuel nozzle (wherein generally like features are represented by like numerals double primed) without the air splitter-swirler member, with the air entry end of a sweep air member positioned downstream in the inner air passage in a low or negative pressure region and with different orifice dimensions, air flow passage cross-sectional areas and thus different swirl number for inner and outer water flows simulating inner and outer air flows. It is apparent that the recirculation zone Z'' impinges on the primary fuel lip 52'' and is narrower in lateral or diametrical dimension than the zone Z' of FIG. 4. The fuel nozzle of FIG. 5 is known to exhibit coking within acceptable levels but the flame front stability produced by it is less than satisfactory for today's gas turbine engine requirements.

Figure 6:
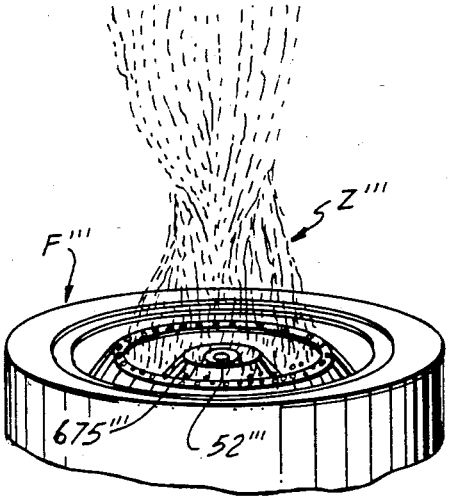
FIG. 6 is similar to FIG. 4 for still another different fuel nozzle shown in FIG. 7.
Figure 7:
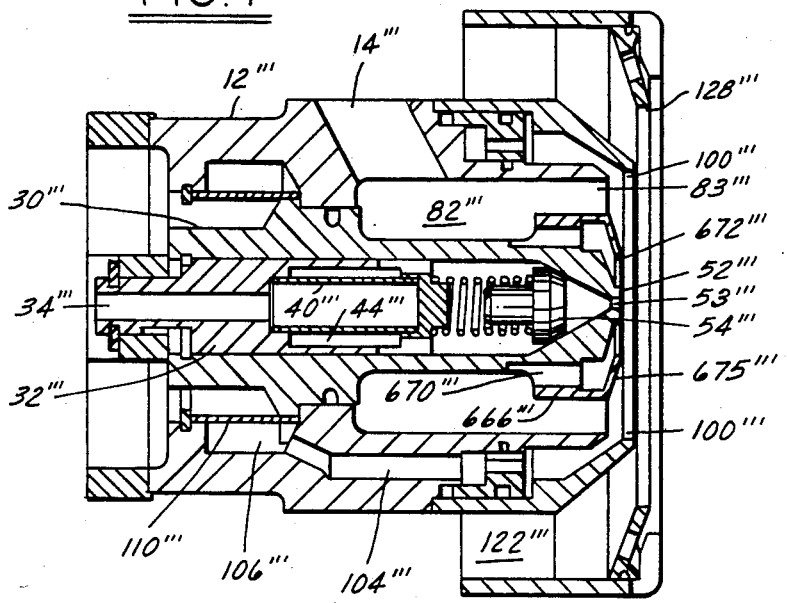
FIG. 7 is a longitudinal cross-section view of a prior art fuel nozzle.

Finally, FIG. 6 shows the recirculation zone Z''' formed in a similar manner in the bubble chamber for the fuel nozzle illustrated in FIG. 7 (where in generally like features have like reference numerals triple primed). It is apparent that the recirculation zone Z''' impinges on a large portion of the nozzle face F''' including primary fuel lip 52''' and exposed face 675''' of the sweep air sleeve 666'''. Coking of the external nozzle face has been determined to be unacceptable for this fuel nozzle.

Figure 9:
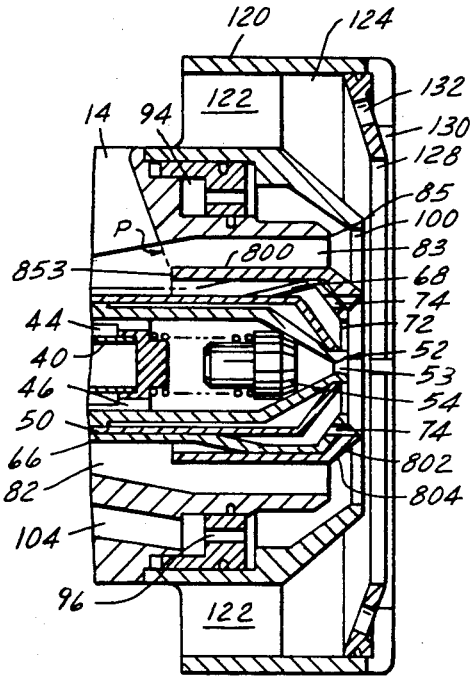
FIG. 9 is similar to FIG. 8 for still another embodiment of the invention.

FIGS. 8 and 9 illustrate other embodiments of the present invention wherein like features are represented by like reference numerals. The fuel nozzle of FIG. 8 differs from that shown in FIG. 1 in that a cylindrical tubular air scoop or splitter member 784 is substituted for the air splitter-swirler member 84 of FIG. 1. The downstream end of the air scoop is attached as by welding or is made unitary with sweep air sleeve 66. The upstream end includes open annular upstream end 753 positioned, as discussed hereinabove, with its open end generally coincident with a projection P of the air inlet apertures 14 into the inner air passage 82 to capture air before substantial air swirling commences for subsequent passage of an inner air stream through chamber 770 and discharge from the sweep air member 66. The remainder of the air in inner air passage 82 is discharged through orifice 83 as an outer air stream in air supply chamber 771 relative to inner air stream in chamber 770 for atomizing secondary fuel.

The fuel nozzles of FIGS. 1 and 8 have exhibited greatly reduced coke formation on the nozzle face as compared to those of FIGS. 4–6 in simulated engine testing and velocity profile and other measurements across their nozzle faces have confirmed that the recirculation zone is spaced away from the nozzle face downstream thereof.

FIG. 9 illustrates still another embodiment wherein like features are represented by like reference numerals. Air scoop or splitter 800 is provided in lieu of the air splitter-swirler member 84 and includes similar features as the air scoop member of FIG. 8. Air scoop member 800 is further provided on the downstream end with a frusto conical end 802 having exposed face 804 with a less severe angle relative to longitudinal axis A to reduce premature air flow separation from that surface.

Those skilled in the art will appreciate that other means may be provided on the nozzle to control inner and outer air flow from the nozzle face lips in a manner to provide a recirculation zone spaced away from the nozzle face a sufficient distance to reduce coking thereof. While certain specific and preferred embodiments of the invention have been described in detail hereinabove, those skilled in the art will recognize that various modifications and changes can be made therein within the scope of the appended claims which are intended to include equivalents of such embodiments.

We claim:

1. In a fuel nozzle useful for a gas turbine engine and having a nozzle face, the combination of fuel supply means on the nozzle, said fuel supply means including an annular fuel discharge body converging in a downstream direction toward a longitudinal central axis of the nozzle and terminating in a downstream fuel discharge orifice substantially on the central axis for discharging fuel from the orifice for mixing with air downstream of the nozzle face, air supply means on the nozzle for discharging air from the nozzle face, and means on the nozzle around the fuel discharge body cooperating with the air supply means for controllably discharging sufficient air flow with locally reduced swirl strength over the fuel discharge body to establish a recirculation zone spaced away from the nozzle face downstream thereof a sufficient distance to substantially reduce coking on the nozzle face.

2. The combination of claim 1 wherein the means for controllably discharging the air flow over the fuel discharge body is disposed in the air supply means.

3. The combination of claim 2 wherein said means for controllably discharging the air flow is disposed adjacent the nozzle face and extends upstream in proximity to inlet air swirl means on the nozzle means supplying air to said air supply means to a location where inlet air swirl is near minimum.

4. The combination of claim 3 wherein said means for controllably discharging air flow splits air flow internal of the nozzle into an inner and outer internal air flow for discharge from different locations on the nozzle face with the inner internal air flow being flowed over a coke-prone surface on the fuel discharge body with locally reduced swirl strength compared to the outer internal air flow.

5. The combination of claim 4 wherein said means for controllably discharging air flow includes thereon means for generating a back pressure upstream thereof in the air supply means.

6. The combination of claim 2 wherein the nozzle includes air inlet means and said means for controllably discharging air flow includes an upstream end generally coincident with an imaginary projection of said air inlet means into the air supply means.

7. In a fuel nozzle useful for a gas turbine engine and having a nozzle face the combination of fuel supply means on the nozzle, said fuel supply means having an annular fuel discharge body terminating in a downstream coke-prone surface having a fuel discharge orifice substantially on the central longitudinal axis of the nozzle for discharging fuel from the nozzle face for mixing with air downstream of the nozzle face, air supply means on the nozzle for discharging swirling air from different locations of the nozzle face including over the coke-prone surface, and means on the nozzle for providing sufficient air flow from the nozzle face locally over the coke-prone surface having a locally reduced swirl strength compared to swirl strength of air discharging from another location on the nozzle face to establish: a recirculation zone spaced away from the nozzle face downstream thereof a sufficient distance to substantially reduce coking of the coke-prone surface.

8. A fuel nozzle for a combustor of a gas turbine engine having a compressor, said fuel nozzle having a body with upstream inlet air swirl means, an inner primary fuel assembly having a conduit defining a primary fuel flow path, another conduit exteriorly disposed of the inner conduit defining a secondary fuel flow path, an inner air flow path between the primary and secondary fuel conduit, said primary fuel conduit terminating in an annular discharge lip on a face of the nozzle and said secondary fuel conduit terminating in an annular discharge lip on a face of the nozzle, and means disposed in the inner air flow path around the inner primary fuel assembly and extending upstream in proximity to the inlet swirl means where inlet air swirl is near minimum for controlling, in combination with the inner air flow path, air flow over the annular discharge lip of the primary fuel assembly to provide sufficient locally reduced swirl strength air flow thereover to establish a recirculation zone spaced away from the nozzle face downstream thereof a sufficient distance to substantially reduce coking on the nozzle face.

9. The fuel nozzle of claim 8 wherein said means for controlling the air flow splits inner air flow through the inner air flow path into an inner and outer inner air flows with the inner air flow having a reduced swirl strength compared to that of the outer inner air flow for discharge of the inner air flow over the annular discharge lip of the primary fuel assembly and the outer inner air flow for discharge from other locations on the nozzle face.

10. The fuel nozzle of claim 9 wherein said means for controlling air flow includes means for creating a back pressure upstream thereof in the inner air path and swirler means for swirling the outer inner air flow.

11. A fuel nozzle useful for a gas turbine engine combustor comprising an axially extending inner primary fuel conduit with a downstream discharge end, an outer annular secondary fuel conduit surrounding and spaced from the primary fuel conduit and having a downstream discharge end, an annular air passage between the primary and secondary conduits with a downstream discharge end, a plurality of air inlet openings upstream of the discharge end of the air passage for supplying air to said air passage including means for imparting a vortex flow to the air flow in the air passage which vortex flow includes a vortex core that expands in a direction from the inlet openings along the air passage toward its discharge end, and an axially extending annular air splitter means in said air passage surrounding and spaced from the primary fuel conduit, said air splitter means having a downstream discharge end around the primary conduit discharge end and an open upstream end positioned axially near the entrance of the air inlet openings into the air passage where the vortex core is near minimum for spitting air flow in said air passage into inner and outer air flows and capturing the inner air flow before substantial vortex flow is imparted thereto and for discharging sufficient inner air flow at the downstream discharge end of the air splitter means over the downstream discharge end of the inner primary fuel conduit with a locally reduced vortex strength compared to discharging outer air flow to establish a recirculation zone spaced away from the downstream discharge end a sufficient distance to substantially reduce coking thereon.

12. A fuel nozzle useful for a gas turbine engine combustor comprising an axially extending inner primary fuel conduit with a downstream discharge end, an outer annular secondary fuel conduit surrounding and spaced from the primary fuel conduit and having a downstream discharge end, an annular air passage formed between the primary and secondary conduits with a downstream discharge end, a plurality of air inlet openings upstream of the discharge end of the air passage for swirling inlet air, and an axially extending annular air splitter means in said air passage surrounding and spaced radially from the primary fuel conduit, said air splitter means having an open downstream discharge end adjacent and spaced from the primary conduit discharge end and having an open upstream end disposed axially in proximity to the air inlet openings where swirl of inlet air is near minimum with said air splitter means forming an inner air passage spaced radially outwardly from the primary fuel conduit to receive air flow from the air inlet openings and with means on the air splitter means for creating a back pressure upstream thereof for providing air to the inner air passage through the upstream end before substantial swirling is imparted thereto and for discharging sufficient inner air flow at the downstream discharge end of the air splitter means over the downstream discharge end of the inner primary fuel conduit with a locally reduced swirl strength compared to discharging outer air flow to establish a recirculation zone spaced away from the downstream discharge end a sufficient distance to substantially reduce coking thereon.

13. The fuel nozzle of claim 12 wherein the upstream end of said air splitter means includes swirler means thereon for swirling air flowing around the exterior of the air splitter means.

14. A method for reducing coking of an external nozzle face of a fuel nozzle operating in the combustor of a gas turbine engine comprising discharging fuel from a downstream fuel discharge body through a fuel discharge orifice substantially on a central longitudinal axis of the nozzle and controlling air flow from the nozzle face to discharge sufficient air flow over the downstream fuel discharge body with the inner air flow having a locally reduced swirl strength compared to swirl strength of other air flow discharging from the nozzle face to establish a recirculation zone spaced away from the nozzle face downstream thereof a distance effective to reduce coking, thereon.

15. A method for reducing coking of a surface on an external nozzle face of a fuel nozzle operating in the combustor of a gas turbine engine comprising introducing inlet air into the nozzle, imparting an increasing swirl to the inlet air as it travels along the length of the nozzle and capturing a sufficient portion of inlet air in the nozzle at a location therein where swirl is near minimum for discharging from the nozzle face and discharging sufficient captured inlet air as a reduced swirl strength air flow locally over a coke-prone surface compared to swirl strength of other air flow discharging from the nozzle face to reduce coking on the coke-prone surface.

16. A method for reducing coking of a surface on an external nozzle face of a fuel nozzle operating in the combustor of a gas turbine engine comprising supplying air internal of the nozzle, swirling the air in the fuel nozzle in the form of a vortex to provide a swirl strength thereto at a nozzle discharge end where the air is discharged, capturing a sufficient portion of the air in the fuel nozzle upstream of the discharge end where swirl of the air is near minimum, conducting said portion to the nozzle discharge end for discharge locally over the coke-prone surface, discharging the captured air over the coke-prone nozzle surface as a reduced swirl strength air flow to reduce coking thereon, and discharging air with said swirl strength from other locations of the nozzle face.

17. The method of claim 16 wherein said portion of air is captured upstream in the area of initial vortex generation in the nozzle where the vortex core is smaller compared to the vortex core downstream near the discharge end.

18. The method of claim 16 wherein said portion is captured near entrance of the air into the fuel nozzle.

* * * * *

UNITED STATES PATENT AND TRADEMARK OFFICE

CERTIFICATE OF CORRECTION

PATENT NO. 4,798,330

DATED : January 17, 1989

INVENTOR(S) : Alfred A. Mancini, James W. Sager and Theodore R. Koblish

It is certified that error appears in the above-identified patent and that said Letters Patent is hereby corrected as shown below:

Column 1, line 47, change "69" to --1969--.
Column 6, line 4, after "52" insert --,--.
Column 7, line 47, after "82" insert --;--.
Column 8, line 2, change "4" to --14--.
Column 8, line 24, change "int" to --into--.
Column 10, line 54, after "face" insert --,--
Column 10, line 68, delete ":".
Column 11, line 27, after "outer" delete --inner--.

Signed and Sealed this

Fifth Day of March, 1991

*Attest:*

HARRY F. MANBECK, JR.

*Attesting Officer*

*Commissioner of Patents and Trademarks*